United States Patent [19]

Loeb

[11] 4,336,754

[45] Jun. 29, 1982

[54] PROPERTY IDENTIFICATION SYSTEM

[75] Inventor: Warner Loeb, Stony Brook, N.Y.

[73] Assignee: Identifax Nationwide Registry, Stony Brook, N.Y.

[21] Appl. No.: 193,483

[22] Filed: Oct. 3, 1980

Related U.S. Application Data

[63] Continuation-in-part of Ser. No. 959,088, Nov. 9, 1978, abandoned, which is a continuation of Ser. No. 743,643, Nov. 22, 1976, abandoned.

[51] Int. Cl.[3] ..... B41L 13/12; B41F 15/02; B42D 3/12

[52] U.S. Cl. ..... 101/127; 33/174 B; 101/114; 101/129; 281/31; 283/8 R; 283/17;

[58] Field of Search ..... 101/114, 127, 127.1, 101/129; 33/174 B; 281/31; 283/8 R;117

[56] References Cited

U.S. PATENT DOCUMENTS

| | | | |
|---|---|---|---|
| 1,500,077 | 7/1924 | Huntington | 434/124 |
| 1,574,953 | 3/1926 | Wood | 33/174 B |
| 1,792,233 | 2/1931 | Malocsay | 33/174 B |
| 1,813,257 | 7/1931 | Rand | 101/368 |
| 2,444,860 | 7/1948 | Summer | 101/127.1 |
| 2,648,366 | 8/1953 | Higbee | 281/31 |
| 2,850,811 | 9/1958 | Boley | 33/174 B |
| 3,158,940 | 12/1964 | Corpening | 33/174 B |
| 3,633,286 | 1/1972 | Maurer | 33/174 B |
| 3,667,990 | 6/1972 | Rogers | 101/129 |
| 3,721,011 | 3/1973 | Anderka | 33/174 B |

*Primary Examiner*—Clyde I. Coughenour
*Attorney, Agent, or Firm*—Kirschstein, Kirschstein, Ottinger & Cobrin

[57] ABSTRACT

A coded property identification system, typically including a stencil and stencil kit, for the marking of personal property with owner identification symbols, to deter theft and also to identify the rightful owner of stolen personal property which has been recovered by law enforcement authorities. The stencil is an elongated flat strip of material such as plastic, which is apertured with a series of openings arranged generally in a line. Each of the openings corresponds to a recognizable symbol such as a number or a letter. In the system, the combination of the symbols for any given stencil is a unique permutation, so that identification of the owner of the personal property may be readily ascertained, once the stencil has been used to etchably or otherwise permanently mark the personal property. The owner of the personal property is ascertained by reference to a particular and specific master code. The correct master code is determined by having at least one of the symbols constitute a master symbol(s) at a predetermined position in the permutation, which position and symbol(s) is common to all the stencils, so that this symbol(s) identifies a particular master code containing the owner's identification keyed to the permutation of the stencil.

1 Claim, 5 Drawing Figures

FIG. 1
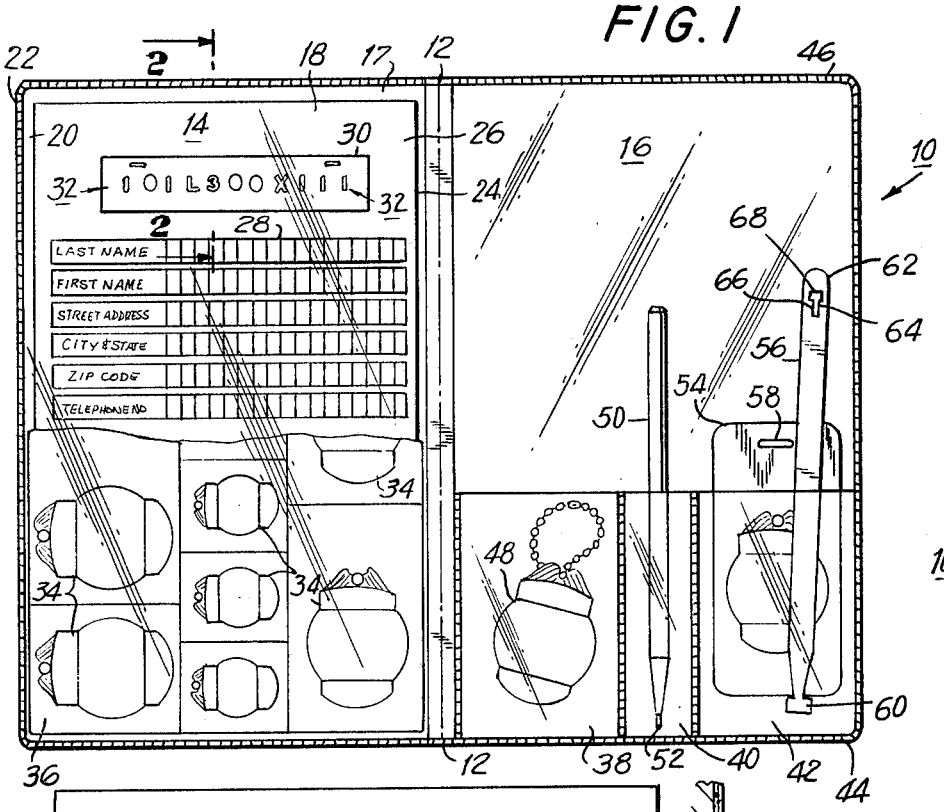
FIG. 2
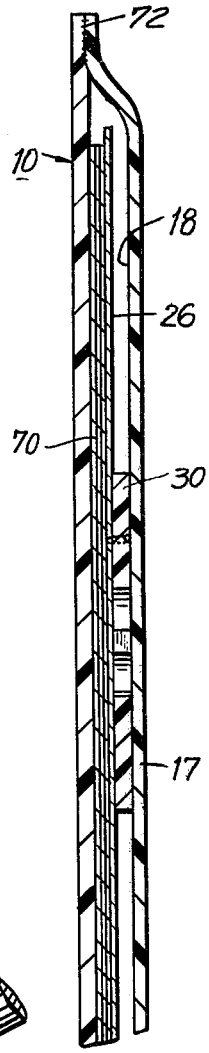
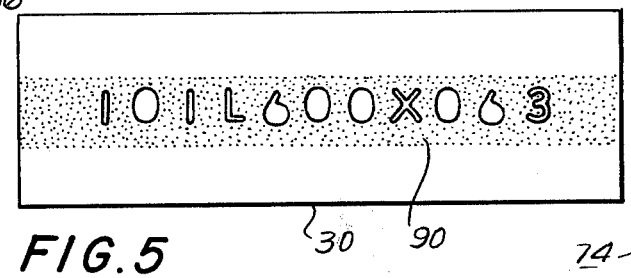
FIG. 5
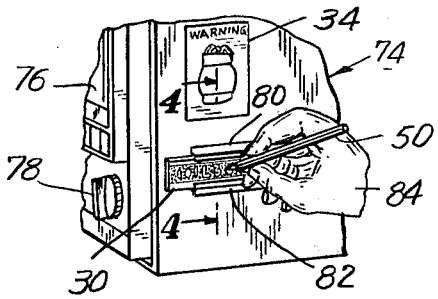
FIG. 3
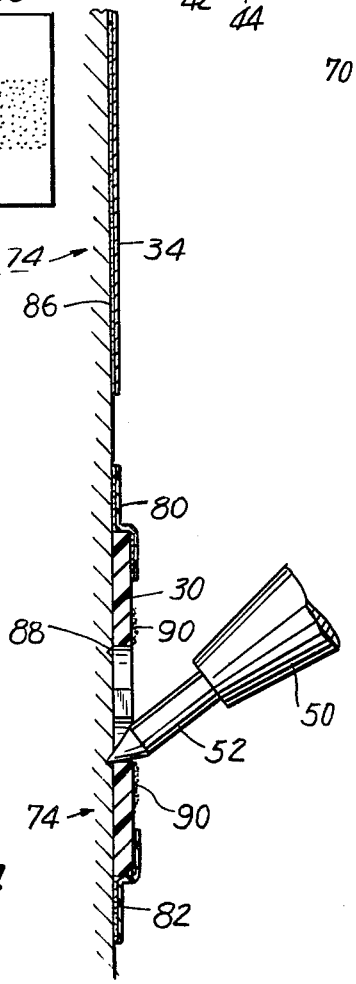
FIG. 4

PROPERTY IDENTIFICATION SYSTEM

CROSS-REFERENCE TO RELATED APPLICATIONS

This application is a continuation-in-part of copending application Ser. No. 959,088 filed Nov. 9, 1978, now abandoned, which is a continuation of application Ser. No. 743,643 filed Nov. 22, 1976, now abandoned.

BACKGROUND OF THE INVENTION

1. Field of the Invention

The invention relates to a stencil and stencil kit for the marking of personal property with identification symbols key coded to a specific master list and to a specific person on that list.

2. Description of the Prior Art

The stenciling of personal property or other goods with identifying numbers or the like is commonly practiced in households, industry and commerce, and for the shipment of goods. In the military service it is common for the serviceman to stencil his serial number on his duffle bag. In households, many people choose to mark their personal property with their social security number or names. Even garbage cans are often marked or painted with the address of the house to which the garbage cans belong. However, non-named identifications are difficult to trace and a public dislike prevails to inscribe a personal name on property.

SUMMARY OF THE INVENTION

1. Purposes of the Invention

It is an object of the present invention to deter the theft of personal property.

Another object is to facilitate the identification of the rightful owner of stolen personal property which has been recovered by law enforcement authorities or agencies, or by others.

An additional object is to provide a stencil and stencil kit for the marking of personal property with owner identification symbols.

A further object is to provide a system which facilitates the identification of the owner of personal property.

Still another object is to provide a system which incorporates a dispersed permutation of symbols that identify a particular and specific master code list, different such code lists being provided to suit different conditions.

Another object is to provide a system having a reference code consisting of at least one symbol dispersed in a permutation of symbols, so that the reference code facilitates the identification of a corresponding particular master code list enabling an entity corresponding to the permutation of symbols to be identified.

Another object is to provide a stencil apertured with a plurality of openings corresonding to recognizable symbols in a particular and unique permutation, and including dispersed master code list identifying symbols, so that the stencil may be employed to mark personal property with the permutation of symbols thus identifying the owner entity of the personal property on a single key coded master list. These and other objects and advantages of the present invention will become evident from the description which follows.

2. Brief Description of the Invention

In the present invention, a property identification system for the marking of an article of personal property or goods is provided, so that the owner of the personal property or goods may readily be identified. Within the context of the present invention, the term personal property will be understood to encompass and include any and all of diverse items, goods, and articles i.e. anything of value which is not real property. Typical articles of personal property contemplated as being eminently suitable for marking, according to the present system, include television sets, bicycles, cameras, hi-fi units, power tools, tape recorders, pocket calculators, appliances, outboard motors, watches, slide and movie projectors, jewelry, auto accessories, radios, tennis rackets, lawn mowers, boating equipment, etc. All of these are characterized by the inclusion of a surface capable of receiving a stenciled marking.

The objective of the present system primarily is to deter crime, especially the theft of personal property from households by burglars, and also to provide a means for readily identifying the rightful owner of stolen personal property which has been recovered by law enforcement authorities or agencies. The present system is also generally applicable to the marking of any types of goods other than individual personal property e.g. shipments of merchandise in boxes or cartons which are the personal property of businesses or corporate entities until properly sold to an individual or corporate consumer.

The problem of crime is ubiquitous and has existed since the earliest development of organized societies. The technology and expertise of the criminal has kept pace with new developments in crime prevention by the use of mechanical devices, e.g. locks, and it is universally recognized that the expert criminal knows how to gain access to the ordinary household in spite of the installation of locks, alarms, window gates, fences, etc. Thus, many individuals, especially in urban areas, choose to keep a dog in their households, so that the unauthorized access of a stranger to the household is curtailed by the barking and/or attack of the dog, especially when the dog is a trained watch dog. However, provision of a guard dog necessitates the care and feeding of the dog and restricts the owner of the dog as far as free movement or travel is concerned, e.g. if the members of the household contemplate an extended trip away from home, the dog must either be taken along on the trip or temporarily placed in a kennel, which is a considerable expense. Nor can a person of average means afford to retain a human guard.

Statistics show that burglary is the most common crime in the country. Currently, a burglar strikes every 13 seconds, a shocking 70% increase in the last five years. One of the best ways to keep burglars out of households is by marking and registering valuable possessions for police identification, e.g. by engraving identifying numbers on valuables and putting up door and window shields, i.e. labels, to warn burglars that the merchandise is marked and traceable by local police. This approach generally stops thieves before they start, because potential thieves know that quick identification of stolen property is a one-way ticket to prosecution and probably jail. Marked and traceable goods are simply too "hot" to handle, and thieves are afraid of being caught with "hot" merchandise. The "fences" who negotiate the sale of whatever loot is brought to them by thieves or burglars will not buy readily identifiable valuables, and burglars rarely go to the trouble of trying to remove or deface etched or engraved numbers. It is virtually impossible to camouflage the defacement and the receiver of the goods knows, or has reason to suspect, that they are stolen.

Millions of dollars worth of stolen goods recovered by the police every year are never returned, because there is no way of readily identifying the owners, or because goods when marked with social security numbers or the like are not readily traceable back to the owners because the significance or meanings of the markings is not readily apparent.

In the present invention, a unique property identification system has been devised. An article of personal property is marked with a permutation of unique owner identification symbols which may readily be correlated with the owner of the personal property or goods. The owner identification symbols are a combination of recognizable symbols in a unique permutation including dispersed symbols that identify a single master code list, so that identification of the owner of the personal property may be ascertained by reference to a single particular master code. Different master lists are used to suit circumstances. The particular master code being used for any particular group of symbols is identified by having at least one of the symbols constitute a master symbol(s) at a predetermined position in the permutation of symbols which position and master symbol(s) is common to all the permutations of a given system, said master symbol(s) at a fixed position corresponding to a reference code identifying the particular master code.

The master symbol(s) may be a number, a letter, or a plurality of numbers and letters. An exemplificative total number of symbols is eleven, with one fixed position master symbol, e.g. a letter, being the fourth symbol in the permutation, and a second fixed position master symbol, also typically a letter, being the eighth symbol in the permutation. For example, the first fixed position letter symbol may be L and the second fixed position letter symbol may be X.

In a preferred embodiment, a stencil is provided consisting of a generally elongated flat strip of flexible material, which is formed with a group of openings arranged generally in a line, each of the openings having a periphery corresponding in its outline to a recognizable symbol. The strip may be transparent and the area of the strip including the line of openings may be colored, e.g. with black dye or paint, so that the openings are clearly visible when the stencil is placed flat against a surface of personal property which is white or lightly colored. By way of example, the strip of material may be a synthetic plastic, e.g. Mylar, nylon, polyethylene, polypropylene or polyvinyl chloride, or a metal foil of aluminum, copper, brass, steel or magnesium alloy AZ 31B.

The stencil is preferably furnished in a kit, which kit provides all of the requisite appurtenances for a complete utilization of the system. The kit includes a folder having a transverse central fold forming two equal sides. One side of the folder has a single pocket encompassing the entire area of the side. A mail-transmissive postcard is furnished to enable the user of the kit and system to transmit his unique and individual permutation of symbols to a central storage facility which may be computerized and which corresponds to the specific reference master code on which the user's identification will appear. The stencil will usually be detachably mounted on the postcard so that the user can simply trace his unique permutation of symbols from the stencil onto the postcard with a pen or pencil and thereafter detach the stencil from the postcard, inscribe his name and address on the postcard, and mail the postcard. The postcard with detachably mounted stencil will be disposed in the one single side pocket.

In addition, the kit includes a group of labels which function as door and window shields for the household of the user of the kit, to warn a potential intruder that the household items are protected. As furnished, the labels will usually be detachably mounted on a release coated backing sheet by a layer of pressure-sensitive adhesive on the labels so that each label may be peeled off the backing sheet with said coating of adhesive and stuck to a door or window. The plurality of labels mounted on the backing sheet will usually be contained in the one single side pocket together with the postcard, and usually an instruction booklet will also be inserted in said side pocket.

The other side of the folder is provided with a plurality of juxtaposed parallel pockets, each of the parallel pockets extending from a closed bottom adjacent an edge of the other side of the folder, to a terminal mouth spaced short of the opposite edge of the other side, so that the parallel pockets encompass only a portion of the area of the other side of the folder. A key tag which is markable with the unique permutation of symbols is disposed in a first of the parallel pockets. A scribing tool having a hardened and sharply pointed scribing tip, to be used in conjunction with the stencil for engraving the unique permutation of symbols onto a surface of an article of personal property, is disposed in a second of the parallel pockets, which second pocket will usually be narrower than the first pocket. A luggage tag and a suitable means to mount the luggage tag on a handle of a piece of luggage is disposed in a third of the parallel pockets. As will appear infra, the means to mount the luggage tag will usually be a small flexible strap of specific conventional configuration. The luggage tag will have an appearance comparable to that of one of the labels. The third parallel pocket will preferably be of a width generally equal to the width of the first pocket, and the second pocket will be disposed between the first and third pockets to provide a symmetrical appearance, as well as to position the relatively heavy stencil tool in the center of the folder.

The parallel pockets will usually be oriented in the other side of the folder in a manner such that the edge of the other side of the folder which is adjacent the bottoms of the parallel pockets is perpendicular to the central fold of the folder, i.e. the lengths of the parallel pockets will be parallel to the fold in the folder. In addition, some or all of the various pockets will usually be composed of a transparent material, e.g. clear plastic sheet, so that the contents of the pockets are visible to the user.

It is important that the pointed tip of the scribing tool be composed of a suitable hard material which will retain its sharpness through periods of extended use. Typically, the pointed tip of the scribing tool will be composed of a hard alloy. Alloy steel is an exemplary material in this regard, specifically a tempered steel which has been hardened to about a Rockwell C 78 or better. Such a pointed tip will scratch or scribe virtually all common materials with the exception of glass. Another suitable and even harder material for the tip is a carbide alloy, e.g. iron carbide or tungsten carbide. Such a pointed tip will even scratch glass.

The means to mount the luggage tag on a handle of a piece of luggage can typically be a flat strip of flexible material, e.g. a synthetic plastic such as nylon, polyethylene, polypropylene or polyvinyl chloride. One end of the strip has transverse arms and the other end of the strip has an opening that permits the transverse arms to be threaded therethrough and inhibited against withdrawal so that the strip can form a closed loop extending around the handle of a piece of luggage, and through a hole in a luggage tag, the structure being conventional.

In service, the present property identification system works as follows. The user stencils his unique permutation of symbols onto articles of personal property. His permutation of symbols is different from every other permutation associated with other persons in the same master code list. The only common similarity is the presence of symbols in predetermined positions which identify the same master code list. The postcard bearing the unique permutation of symbols as well as the name and address of the user is sent to a central, usually computerized, station, and the information on the postcard is fed into the computer. An article, if then stolen and subsequently recovered by the police or other law enforcement authorities, bears the unique permutation of symbols, and the police, having been alerted to recognize the reference code, correlate the reference code with a telephone number which is usually a toll-free call. Thus a simple phone call, during which the police recite the unique permutation of symbols on the article to the receiver of the call, enables the receiver to feed the unique permutation of symbols into the computer, which will immediately match up the permutation of symbols with the correct owner, and the phone call receiver will obtain a print-out of the correct owner's name and address. This information then is given to the police who will return the article to the rightful owner. The registry of the central computer system is accessible to police everywhere, 24 hours a day, 7 days a week. No matter where the owner moves or travels, or where the stolen property is recovered, police officials can quickly locate the owner and return the personal property to the owner.

The present invention provides several salient advantages. A primary advantage is that it deters crimes such as theft or burglary, and also facilitates the identification of the rightful owner of stolen personal property which has been recovered by law enforcement authorities or agencies. The registration, consisting of a unique permutation of symbols, is exclusive and private and is of no use to anyone other than the owner of the personal property. The reference code enables the correct identification of the particular master code, so that confusion or error as to proper ownership is eliminated. Since all information as to recovered stolen goods may be conducted by telephone, the prompt return of the stolen goods to their rightful owner is expedited.

The invention accordingly consists in the features of construction, combination of elements, and arrangements of parts which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention:

FIG. 1 is a plan view of an outfolded stencil kit according to the invention;

FIG. 2 is an enlarged sectional elevation view of a portion of the stencil kit of FIG. 1 taken substantially along the line 2—2 of FIG. 1;

FIG. 3 shows the stencil in use to mark an article of personal property;

FIG. 4 is an enlarged sectional elevation view of a portion of FIG. 3 taken substantially along the line 4—4 of FIG. 3; and FIG. 5 shows another stencil with the same master code symbols as the stencil in the FIG. 1 kit.

DETAILED DESCRIPTION OF THE PREFERRED EMBODIMENTS

Referring now to FIGS. 1 and 2, the stencil kit includes a folder 10 having a central fold 12, so that the folder 10 is divided into two equal sides 14 and 16. The side 14 has a single transparent panel 17 forming a pocket 18 encompassing the entire area of the side 14, i.e. the bottom 20 of the panel is at and secured to the outer edge 22 of the side 14, the open mouth 24 on the pocket is adjacent the central fold 12, and the top and bottom of the panel are at and secured to the respective top and bottom edges of the side 14.

A mail-transmissive postcard 26 is disposed in the central opening pocket; as shown, the postcard 26 includes outline spacings 28 for the name, address and telephone number of the owner, i.e. the person whose personal property is to be protected.

A stencil 30 is detachably mounted on the postcard 26. The stencil 30 has apertures consisting of the outlines of eleven symbols 32 in a unique permutation of recognizable symbols; in this embodiment of the invention the letter "L" appears in the fourth position of the permutation and the letter "X" appears in the eighth position of the permutation of symbols. The remaining symbols are numbers. The letters are master symbols identifying a specific master code list in the possession and under the control of a responsible company or person, the list being of protected clients whose names, addresses and telephone numbers are correlated with identifying numbers corresponding to the number symbols on all the different stencils. Police departments and law enforcement agencies are supplied with the name, address and telephone number of the companies and persons having different master codes corresponding to the master code symbols.

The stencil 30 is an elongated an flat strip of flexible material; in this embodiment the stencil 30 is oblong and the symbols 32 are aligned in a straight line along the longer axis of the stencil. Upon receipt of the folder 10, the personal property owner will trace the symbols 32 onto the postcard 26 with a pen or pencil, detach the stencil 30 from the postcard 26, fill in his or her name and address, and mail the postcard to a central computerized location, the address of which is usually preprinted on the reverse side of the postcard.

The pocket 18 also contains a plurality of labels 34 strippably mounted on a sheet 36 by means of backing layers of pressure sensitive adhesive on the labels, so that the labels 34 may be peeled off from the sheet 36 and attached to a window, a door or an article of personal property. The labels bear a legend advising that the property identification system is being employed.

Referring now to the right side 16 of the folder 10, three transparent parallel pockets 38, 40 and 42 are provided parallel to the centerfold 12, with the bottom of each pocket 38, 40 or 42 at the bottom edge 44 of the folder 10 perpendicular to the centerfold. The middle pocket 40 is narrower than the outer equal sized pockets 38 and 42. All pockets 38, 40, and 42 are of equal depth and terminate at upper mouths facing but below the upper edge 46 of the folder.

A key tag 48 which is markable with the unique permutation of symbols of the stencil 30 is disposed in the pocket 38. A stencil marking tool 50 having a hard pointed engraving tip 52 is disposed in the pocket 40. A luggage tag 54 and a luggage strap 56 consisting of a flat strip of flexible material are disposed in pocket 42. The luggage tag 54 is provided with a hole 58 through which the strap 56 is designed to be threaded. One end 60 of the strap 56 is provided with transverse terminal arms and the other end 62 of the strap 56 is provided with an opening 64 to pass the end 60. The opening 64 is T-shaped, the shank 66 of the T having a length about equal to the width of the strip 56 and a width about equal to the thickness of the strip. The head bar 68 of the T has a width greater than the spread of the arms 60 so that the strip 56 may be converted into a closed loop in a conventional manner.

Both the key tag 48 and the luggage tag 54 are provided with the same warning legend and apparearance i.e. a shield, as the labels 34. An owner marks the key tag with a marking constituting his unique permutation of symbols. The stencil 30 is disposed in front of and stapled on the postcard 26; an instruction booklet 70 is placed behind the postcard 26 in the pocket 18. A weld 72 joining the panel 17 to the top edge of folder 10 is also shown in FIG. 2.

FIGS. 3 and 4 show a permutation of recognizable symbols being permanently manually scratched or engraved on the side of a television receiver 74 having a viewing screen 76 and a control knob 78. Strips of pressure-sensitive tape 80 and 82 may be used temporarily to hold the stencil 30 in place; however, alternatively the stencil 30 may be manually held in place with one hand while another hand 84 manipulates the stencil tool 50. A warning label 34 has been affixed to TV set 74 by a presure-sensitive aggressively adhesive backing 86 (FIG. 4). A scratch 88 has been made in the surface of the TV set with the stencil tool 50 being manipulated to follow the outline of an aperture, in this case in the form of the numeral 3 in the stencil. FIGS. 3 and 4, as well as FIG. 5, show an alternative embodiment of stencil 30 in which a layer or coating of dye or paint, designated as 90, is provided on the under surface of stencil 30 adjacent the apertures so that the apertures are more readily visible during the engraving step shown in FIG. 4. FIG. 5 also shows a stencil 30 having a second unique permutation of recognizable symbols differing from that of FIG. 1; because the second permutation is keyed to the same master reference code as the first, the letter "L" is in the fourth position of both permutations and the letter "X" is in the eighth position.

It thus will be seen that there is provided a property identification system which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A plurality of stencils for the marking of personal property with owner identification symbols, each stencil bearing a unique permutation of symbols and being assignable to one specific person who is an owner of personal property, each stencil comprising an elongated flat strip of flexible material, each stencil having a group of openings aligned substantially in a line, each of said openings being shaped to correspond to a recognizable symbol, a scribing tool having a hard pointed scribing tip for cooperating with said openings to engrave on items of personal property a group of symbols corresponding to the group of openings on the stencil, whereby the group of symbols thus scribed onto items of personal property with each stencil are the same for a specific person, at least two of said symbols at individually interspersed predetermined fixed spaced positions in the group of symbols on each stencil of the plurality of stencils being identical for all of the plurality of stencils and constituting identical master symbols identifying a specific master code list that is different for every different plurality of stencils, the balance of the symbols of each stencil, in combination with said two symbols, being a unique permutation different from the permutations of symbols on each of the remainder of the plurality of stencils, whereby the group of symbols on every single stencil is distinctly different from the group of symbols on every other stencil of the plurality of stencils by virtue of the unique permutation of symbols carried thereby, exclusive of said two symbols, and is the same as every other stencil of said plurality of stencils in respect of the common two said symbols, so that the singular group of symbols on each stencil can be associated with a specific owner of personal property and all of said singular groups of the plurality of stencils when engraved on an item of personal property can be associated with a single master list identified by said two symbols and each group can be associated with a common specific owner on said common specific master list.

* * * * *